US010822817B2

(12) United States Patent
Drozdov et al.

(10) Patent No.: US 10,822,817 B2
(45) Date of Patent: Nov. 3, 2020

(54) LIFTING AND CARRYING SYSTEM FOR MAINTAINING BUILDING FACADES

(71) Applicant: LIMITED LIABILITY COMPANY "UNITED FACADE COMPANY", Moscow (RU)

(72) Inventors: Aleksandr Iurevich Drozdov, Moscow (RU); Sergey Ilyich Lakhman, Leninksy r-n (RU)

(73) Assignee: LIMITED LIABILITY COMPANY "UNITED FACADE COMPANY", Moscow (RU)

( * ) Notice: Subject to any disclaimer, the term of this patent is extended or adjusted under 35 U.S.C. 154(b) by 0 days.

(21) Appl. No.: 15/564,049

(22) PCT Filed: Mar. 30, 2016

(86) PCT No.: PCT/RU2016/050005
§ 371 (c)(1),
(2) Date: Oct. 3, 2017

(87) PCT Pub. No.: WO2016/159837
PCT Pub. Date: Oct. 6, 2016

(65) Prior Publication Data

US 2018/0093864 A1 Apr. 5, 2018

(30) Foreign Application Priority Data

Apr. 3, 2015 (RU) ..... 2015112184

(51) Int. Cl.
*E04G 3/24* (2006.01)
*B66B 9/02* (2006.01)
(Continued)

(52) U.S. Cl.
CPC ..... *E04G 3/243* (2013.01); *B66B 9/022* (2013.01); *B66B 9/16* (2013.01); *B66B 9/187* (2013.01); *E04G 3/28* (2013.01); *E04G 3/246* (2013.01)

(58) Field of Classification Search
CPC .... A62B 1/00; A62B 1/02; A62B 1/20; B66B 9/00; B66B 9/16; E04G 3/28;
(Continued)

(56) References Cited

U.S. PATENT DOCUMENTS 1,708,113 A * 4/1929 Allen ..... E06C 5/28 182/62.5
2,798,623 A * 7/1957 Girardi ..... A01D 46/20 414/508
(Continued)

FOREIGN PATENT DOCUMENTS

DE 296 21 330 U1 4/1998
JP S56-52379 A 5/1981
(Continued)

OTHER PUBLICATIONS

International Search Report and Written Opinion dated Aug. 18, 2016 issued in corresponding application No. PCT/RU2016/050005; w/ English partial translation and partial machine translation (7 pages).
(Continued)

*Primary Examiner* — Colleen M Chavchavadze
(74) *Attorney, Agent, or Firm* — Seckel IP, PLLC

(57) ABSTRACT

Lifting devices for residential, public and industrial buildings and structures, and more specifically, lifting and carrying systems for maintaining building facades, having rail or mast-type guides, which are arranged on the external wall of the building and equipped with teeth, and a lifting device with a drive including a motor with a gearbox, and a toothed
(Continued)

wheel mounted on the drive shaft of the gearbox to engage with the teeth of the guides so that, when the toothed wheel rotates, the lifting device moves along the guides. The shapes of the guides duplicate that of the building, and they are attached to the building by brackets passing through the building facade and secured to load-bearing structures of the building. The lifting device has a platform, each edge of which is hinged to a frame connecting two carriages each having a system of guiding thrust rollers supported on the guides.

5 Claims, 3 Drawing Sheets

(51) Int. Cl.
*B66B 9/187* (2006.01)
*B66B 9/16* (2006.01)
*E04G 3/28* (2006.01)

(58) Field of Classification Search
CPC ..... E04G 2003/286; E04G 1/20; E04G 3/243; E04G 3/246
See application file for complete search history.

(56) References Cited

U.S. PATENT DOCUMENTS 3,207,263 A * 9/1965 Cull ..... B66B 9/022 180/7.1
3,592,294 A 7/1971 Allen
3,907,066 A * 9/1975 Newton ..... E04G 3/24 182/112
3,927,732 A * 12/1975 Ooka ..... B66F 11/04 182/36
4,018,306 A * 4/1977 Lyons ..... A62B 1/00 104/173.1
4,257,491 A * 3/1981 Presnall, Jr. ..... E04G 3/22 182/142
4,406,349 A * 9/1983 Vilchek ..... A62B 35/0062 182/7
4,433,752 A * 2/1984 Günter ..... B66B 9/022 182/142
4,620,612 A * 11/1986 Enoki ..... B63C 5/02 182/113
4,664,226 A * 5/1987 Centanne ..... A62B 1/02 182/141
4,828,072 A * 5/1989 Ho ..... A62B 1/02 182/82
4,865,155 A * 9/1989 Montaigne ..... A62B 1/02 182/14
5,301,770 A * 4/1994 Regan ..... E04G 3/30 182/128
6,431,078 B2 * 8/2002 Serrano ..... B61B 13/00 104/106
6,533,070 B1 * 3/2003 Elrod ..... E06C 1/345 182/103
7,004,286 B2 * 2/2006 Fredette ..... B66F 11/04 182/62.5
7,004,288 B2 * 2/2006 Araki ..... B66F 11/04 182/103
7,178,635 B2 * 2/2007 Meissner ..... B66B 9/00 187/249
7,191,873 B2 * 3/2007 Korchagin ..... B66B 9/16 182/141
7,281,607 B1 * 10/2007 Kiraly ..... A01M 31/02 182/102
7,740,107 B2 * 6/2010 Lemburg ..... E04G 3/30 182/142
7,857,104 B2 * 12/2010 Kocher ..... B66B 9/00 187/249
8,151,941 B2 * 4/2012 Moses ..... B66B 9/187 182/37
8,695,249 B1 * 4/2014 Al Hasan ..... G09F 21/00 182/141
8,800,717 B2 * 8/2014 Berry, Jr. ..... B60R 3/005 182/131
8,925,689 B2 * 1/2015 Jacobs ..... B66B 11/0095 187/249
9,834,944 B2 * 12/2017 Maurer ..... B66B 9/022
9,963,889 B2 * 5/2018 Shen ..... E04G 3/32
2005/0087393 A1 4/2005 Korchagin et al.
2006/0144639 A1 * 7/2006 Iacoviello, Jr. ..... A62B 1/02 182/82
2007/0119331 A1 * 5/2007 Korchagin ..... A62B 1/02 104/307
2008/0053750 A1 * 3/2008 Tseng ..... A62B 1/02 182/82
2012/0018253 A1 * 1/2012 Taberah ..... B66B 9/187 182/141

FOREIGN PATENT DOCUMENTS

KR 10-2011-0067776 A 6/2011
RU 2 349 532 C2 3/2009
RU 134 917 U1 11/2013

OTHER PUBLICATIONS

Australian Office Action dated Apr. 14, 2018 in corresponding Australian application No. 2016241146 (in English; 5 pages) (D1, US20050087393 cited in the Australian Office Action is not listed in this IDS since it was already listed in the IDS Filed Oct. 3, 2017).
European Extended Search Report and Written Opinion dated Oct. 24, 2018 in counterpart application No. EP16773559.6; in English (9 pages) (D2, U.S. Pat. No. 3,207,263 cited in the EESR is not listed in this IDS since it was already listed in the Office Action dated Sep. 28, 2018).
Eurasian Office Action dated Feb. 12, 2019 in counterpart application No. EA301/2017; with English translation (4 pages) (D3, U.S. Pat. No. 3,207,263 cited in the EA Office Action is not listed in this IDS since it was already listed in the Office Action dated Sep. 28, 2018).
WIPO English Translation of International Written Opinion dated Aug. 18, 2016 issued in corresponding application No. PCT/RU2016/050005 (4 pages).
European Office Action dated Jul. 30, 2019 in counterpart application No. EP16773559.6 (notification of allowable subject matter); in English (total 7 pages).
Australian Office Action dated Aug. 15, 2019 in counterpart patent No. AU2016241146 (notification of grant); in English (total 1 page).
European Notice of Allowance dated Mar. 25, 2020 in counterpart application No. EP16773559.6, with granted application text; in English (total 46 pages).
Eurasian Office Action dated Dec. 17, 2019 in counterpart application No. EA 201700461/31; with English translation (total 5 pages).
Ukrainian Office Action dated Nov. 21, 2019 in counterpart application No. UA 201710631; with English machine translation (total 8 pages) (D1, JPS56-52379 and D2, U.S. Pat. No. 3,207,263 cited in the UA Office Action are not listed in this IDS since they were already listed in the IDS filed Mar. 28, 2019 and in the Office Action dated Sep. 28, 2018, respectively).

* cited by examiner

LIFTING AND CARRYING SYSTEM FOR MAINTAINING BUILDING FACADES

TECHNICAL FIELD OF THE INVENTION

The invention relates to lifting devices for residential, public and industrial buildings and structures, and more specifically, to lifting and carrying systems for maintaining building facades, and is comprised of rail- or mast-type guides, located on the external wall of the building and equipped with teeth or other engaging elements, such as pins or rollers, and a lifting device having a drive, wherein the drive includes a motor with a gearbox and a toothed wheel mounted on the drive shaft of the gearbox so as to be able to engage with the above-mentioned teeth of the guides in such a manner that during rotation of said toothed wheel, said lifting device moves along the guides; the system additionally comprises control means capable of controlling the motor.

The following terms are used in this specification.

Vertical—a direction parallel to the force of gravity.

Horizontal—a direction perpendicular to the force of gravity.

Longitudinal—direction a direction along the surface of the building or along the tangent to the surface of the building.

Transverse direction—a direction perpendicular to the surface of the building.

Toothed wheel—a part, capable of rotating around its axis, and having projections of arbitrary shape. This also applies to an embodiment in the form of a sprocket, or any other design version of a part having teeth or other engaging elements, such as pins or rollers.

PRIOR ART

This invention relates to a lifting and carrying system for maintaining building facades, comprising rail- or mast-type guides, located on the external wall of the building and equipped with teeth, and a lifting device having a drive, wherein the drive includes a motor with a gearbox and a toothed wheel mounted on the drive shaft of the gearbox so as to be able to engage with the above-mentioned teeth of the guides in such a manner that during rotation of said toothed wheel, said lifting device moves along the guides; the system additionally comprises control means capable of controlling the motor.

Such system is described in the Russian Federation utility model patent RU 134917, published in 2013.

This system is the closest to the proposed invention based on the technical essence and achieved technical result, and therefore, was chosen as a prototype.

The disadvantage of this prototype results from the fact that it is not possible to use it on buildings having a complex shape, such as a complex curved surface of the facade, while the number of such buildings is constantly growing.

This is due to the fact that by using the system described in the prototype, it is impossible to provide access to various sections of building facades having a complex curved surface, since the prototype system is only able to move along a single vertical guide, while in the case of a building having a complex shape, such direction may not even exist. This makes the prototype system completely unfit for use on buildings that have a complex curved surface of the facade.

In addition, there are other disadvantages of the prototype, such as:

- this prototype cannot provide access to the extended horizontal section of the building facade;
- this prototype does not have the ability to stabilize the horizontal position of the platform;
- this prototype cannot change the geometry of the platform itself, while adjusting its shape to that of the building facade.

DESCRIPTION OF THE INVENTION

This invention is mainly intended to provide a lifting and carrying system for maintaining building facades, which allows to mitigate at least one of the above-mentioned disadvantages, namely, to expand the field of application of the system by allowing it to be used on building facades having complex form, which is the technical objective.

To achieve this objective, the rail- or mast-type guides have a shape that mimics the shape of the building and are attached to the building by means of brackets passing through the building facade and secured to the load-bearing structures of the building, while a lifting device includes a platform, each edge of which is hinged to a trolley in the form of a frame connecting two carriages, each of which represents a system of guiding thrust rollers resting on the rail- or mast-type guides.

Because of these advantageous characteristics, it becomes possible to use the proposed system on the facades of buildings having a complex shape. This is enabled by a special shape of the guides, which are attached to the building's load-bearing structures, and a special platform, located between the two guides, wherein said platform is attached to the trolleys, which in turn are attached to the carriages, each of which represents a system of guiding thrust rollers resting on the rail- or mast-type guides.

In a preferred version of the invention, the platform is embodied in the form of a telescopic sectional platform. Due to this advantageous characteristic, it becomes possible to use the lifting and carrying system in cases, when the guides are positioned at a relatively large distance from each other, when the curvature of the facade starts to play a role, and it becomes necessary to adapt the shape of the platform itself to the shape of the curved facade. In addition, such a feature allows moving the platform in a vertical direction while adjusting the shape thereof, which in turn allows matching the shape of the platform to that of the curved facade. This is why the platform is constructed of individual sections, which are telescopically enclosed within each other. Generally, it is possible to connect several platforms into a single complex shape structure. It is also possible to have several platforms at different levels on the same guides.

In another preferred version of the invention, the platform has a horizontal position stabilization system. Due to this advantageous characteristic, it becomes possible to automatically maintain the horizontal position of the platform. This is especially important, since the platform is intended to have people on it at great heights, and non-horizontal position of the platform cannot be allowed.

In yet another version of the invention, the system for stabilizing the platform in a horizontal position is embodied in the form of a mechanical or electromechanical system for providing stabilization in a transverse direction. Due to this advantageous characteristic, it becomes possible to stabilize the platform in the transverse direction.

In yet another version of the invention, the system for stabilizing the platform in a horizontal position has a sensor, specially designed for synchronizing the movement of the carriages along the guides and slowing down the carriage that is getting ahead using a signal from the sensor to provide stabilization of the platform in the longitudinal direction. Due to this advantageous characteristic, it becomes possible to provide stabilization of the platform in the longitudinal direction. In reality, the length of the platform in the longitudinal direction by far exceeds its transverse dimensions. And horizontal stabilization in the longitudinal direction occurs due to synchronization of the carriage movement along the guides. Such synchronization is controlled by a special sensor, which sends control signals causing carriages on each edge of the platform to move.

In yet another possible version of the invention, the carriages have a locking system, specifically intended to be activated during an emergency situation. Due to this advantageous characteristic, it becomes possible to improve the safety of those working on the platform.

In yet another version of the invention, the carriages are equipped with limit switches. Due to this advantageous characteristic, it becomes possible to ensure that the carriage stops.

In yet another version of the invention, a drive mounted onto each carriage moves the carriage along the guide by means of a "gearwheel toothed rack" or a "sprocket chain" transmission. Due to this advantageous characteristic, it becomes possible to ensure engagement between the carriage elements and the guides. This can be embodied in the "gearwheel toothed rack" or "sprocket chain" versions.

In yet another version of the invention, the motors are equipped with a normally blocked electromagnetic brake configured to operate if triggered by a spring in the absence of electricity. Thanks to this advantageous characteristic, it becomes possible to increase the safety of work using the proposed system and provide an alternative option for braking in the absence of electricity.

In yet another version of the invention, the platform has a speed limit control device. Due to this advantageous characteristic it becomes possible to progressively or smoothly stop the platform in case of exceeding the set value.

In yet another version of the invention, the platforms are equipped with a proximity control system with regard to a platform located above or below when moving up or down. The system has two modes:

1—to prevent a doubled load on the guides (provides the distance between the platforms, which guarantees the transfer of load to the guide from only one platform), 2—if the guide is capable of withstanding the load from two platforms, the system allows avoiding collision of the platforms when moving up or down. The carriages are equipped with independent sensors for each mode.

The combination of essential features of the proposed invention is unknown from the prior art with regard to devices serving a similar purpose, which allows to conclude that the invention as a device satisfies the "novelty" criterion. Also, the combination of essential features of the proposed invention does not explicitly follow from the prior art for devices having a similar purpose, which makes it possible to conclude that the "inventive step" criterion has been met.

BRIEF DESCRIPTION OF THE DRAWINGS

The other distinctive features and advantages of the invention clearly follow from the description, which is provided below for illustration purposes, and is not limiting, with reference to the accompanying drawings, in which.

The following nomenclature is used in the figures.

Figure 1:
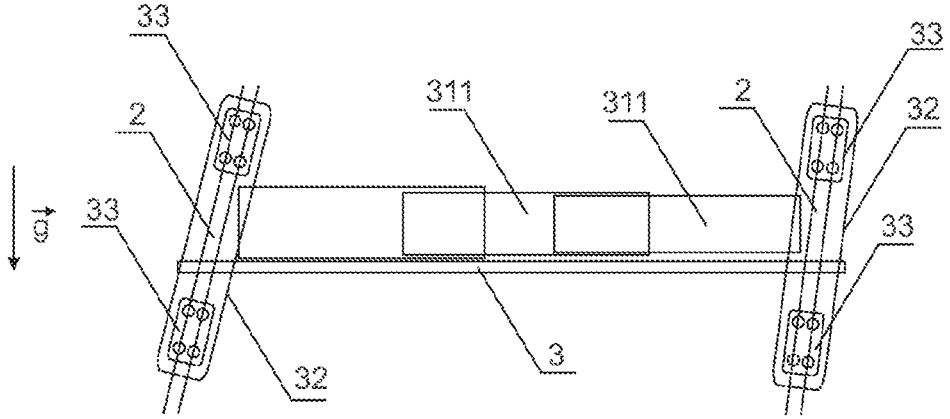
FIG. 1 shows a side view of the lifting and carrying system for maintaining building facades according to the invention (direction of the gravitational force is shown)
Figure 2:
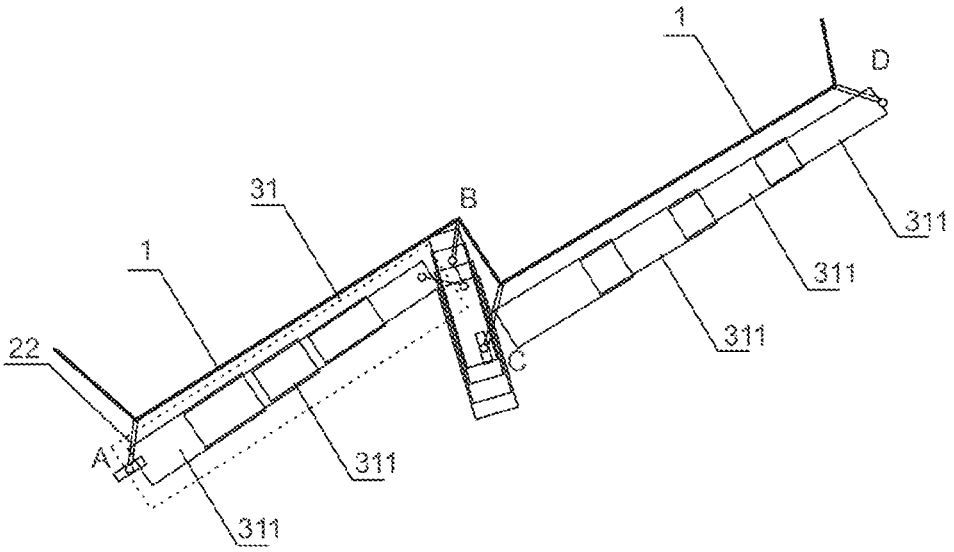
FIG. 2 shows a top view of the lifting and carrying system for maintaining building facades according to the invention.

1—external wall of the building,
2—guides,
  21—guide teeth,
  22—guide bracket
3—lifting device,
  31—lifting device platform,
    311—lifting device platform section
  32—lifting device frame,
  33—lifting device carriage,
  34—lifting device platform stabilization system in the transverse direction,
  35—sensor to ensure platform stabilization in the longitudinal direction,
  36—blocking system
  37—limit switch
  38—upper console,
  39—upper crosshead
  391—upper crosshead carriage
4—lifting device drive,
  41—lifting device motor,
  42—lifting device drive gearbox,
  43—lifting device drive gearwheel,
  44—normally closed electromagnetic brake,
  45—rotation flywheel for lowering the carriages in emergency situations,
  46—emergency wedge catcher device,
  47—overload device
5—management tool According to FIGS. 1 to 4, the lifting and carrying system for maintaining building facades comprises rail- or mast-type guides 2, located on the external wall 1 of the building and provided with teeth 21, and a lifting device 3 having a drive 4. The rail- or mast-type guides 2 have a shape that repeats the shape of the building and are attached to the building by means of brackets 22, passing through the facade of the building and secured to the load-bearing structures of the building. Depending on the shape of the building, the configuration of the guides 2 can be different—they can be not only vertical, but also inclined, straight or curved, with a positive angle or with a negative angle.

The lifting device 3 includes a platform 31, each edge of which is hinge-mounted to the frame 32 linking two carriages 33 hinged to the frame, each of which represents a system of guide thrust rollers resting on the rail- or mast-type guides 2. Each frame 32 with carriages 33 has its own drive 4, which includes a motor 41 with a gearbox 42, and a toothed wheel 43 installed on the drive shaft of the gearbox 42 capable of engaging with said teeth of the guides 2 in such a manner that when the toothed wheel 43 rotates, the lifting device 3 moves along the guides 2; the system also includes control means 5 embodied with the possibility to control the motor 41.

Platform 31 can be embodied in the form of a telescopic section platform, i.e., consisting of sections 311, which are telescopically inserted into each other and have locks preventing the disengagement of the sections 311. It is possible to have a version, when the platform consists of two or more telescopic sections and several sectional platforms with a "scissors" type connection—the version shown in FIG. 2.

Platform 31 may have a horizontal position stabilization system.

The system for stabilizing the platform in horizontal position can be embodied in the form of a mechanical or electromechanical stabilization system 34 in the transverse direction.

The system for stabilizing the platform in horizontal position can be provided with a sensor 35 specifically intended for synchronizing the movement of the carriages along the guides and slowing down the carriage that got ahead based on the signal from the sensor to ensure stabilization of the platform in the longitudinal direction.

The carriages 33 may be equipped with a locking system 36, specifically intended to be activated during emergency situations. The carriages may be equipped with limit switches 37.

When the platform 31 is lowered/raised under normal conditions by the drive 4, the stabilization system 34 operates by switching off the power of the drive that got ahead by operating the limit switch 37 driven by a rod via a camshaft mechanism. The same mechanism activates the braking device via a cable when descending in the manual mode.

Each carriage 33 can be equipped with a drive 4, which moves the carriage along the guide by means of a "gearwheel—toothed rack" or "sprocket-chain" transmission. The chain can be flexible or rigid.

The motors 41 can be equipped with a normally blocked electromagnetic brake 44, configured to be actuated by the spring in the absence of electricity.

As already mentioned, each carriage 33 is provided with an integrated gearbox 42 having a driving toothed wheel 43 or a sprocket. The movement is transferred to the driving toothed wheels 43 via a gearbox 42 from the drive 41 located on the carriage 33 and connected to the carriage gearbox 42 via a quick-release tapered shaft. The driving toothed wheels 43 of the carriages engage with the rack bar (or a static, phased chain) secured inside the guide 2.

Figure 3:
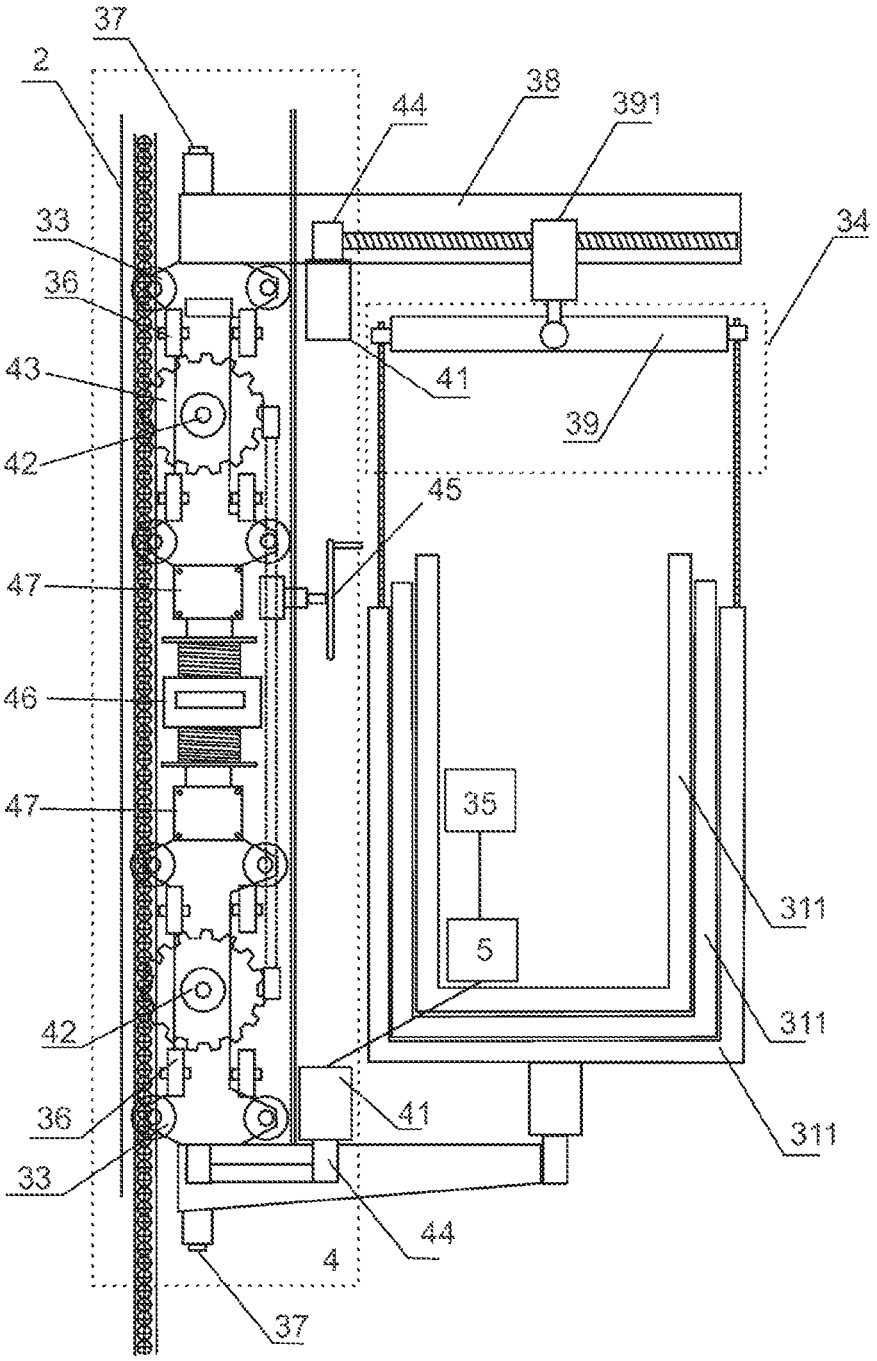
FIG. 3 shows a vertical sectional view of the lifting and carrying system for maintaining building facades according to the invention.
Figure 4:
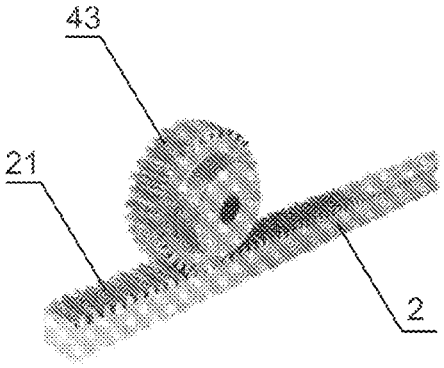
FIG. 4 shows a connection version between a guide and a toothed wheel of the lifting device drive according to the invention, FIG. 5 schematically shows the steps of utilizing the lifting and carrying system for maintaining building facades according to the invention.

FIG. 3 shows a schematic diagram of the carriage 33 with the stabilization system. In this example, the compensation of the inclination angle of the main guide 2 results from the movement of the upper crosshead 39 toward or away from the facade along the upper console 38. The crosshead carriage 391 moves synchronously as the main carriages 33 are lifted/lowered by using a "nut-screw" transmission. The leading screw of this transmission is kinematically connected with the carriage gearbox, which allows compensating the inclination angles, determined by the building geometry, of the main guide 2 by about +/−14°.

The speed of movement of the platform 31 can be as high as 9 m/min. The electric power for the lifting device drive motors 41 is supplied via busbars placed inside the guides 2. Platform 31 may also be equipped with a speed limit control device ensuring a progressive (smooth) stop if the setpoint is exceeded.

The speed control device has a gearwheel, which is constantly engaged with the toothed rack (chain) and drives the axle with the reference weight attached to it, which actuates the brake cone under a centrifugal force, thus resulting in tightening the brake and causing a smooth stopping of the platform, while simultaneously de-energizing the drives.

The guide 2 represents a hexagonal (possibly, round or rectangular) pipe having a constant cross-section with a circumscribed circle diameter of, for example, 450-500 mm.

Height-wise, the guides 2 are positioned along the edges of the building. At each external or internal corner or surface of the building/structure, one or more guides 2 can be installed. The guides 2 are attached to the building by means of brackets 22 passing through the facade of the building and secured to the load-bearing structures of the building. The mounting distance between the brackets height-wise is determined by calculation. Facade lamps can be installed along the guide 2. The guides 2 can also have a decorative finish.

The telescopic platform 31 can have the required length, for example, 20 m. Each of the sections 311 represents a spatial rod system forming a fence and a floor for the maintenance personnel, interlocked with the main support beam.

In the ABC version of the telescopic platform (see FIG. 2), the length of the AB section is about 20 m, and the length of the BC section is about 8 m. Each of the sections represents a spatial rod system that forms a fence and a floor for the maintenance personnel and is interlocked with the main load-bearing beam. The AB link, which is the closest to the guide B, has an additional bus for moving along a special carriage, to which a BC platform is hinged with the side opposite to point C. Such an attachment scheme, with the BC beam attachment point "floating" along the AB beam, allows increasing the span between the points B and C if they get too close, which in turn helps reducing the console protrusion of the beam/platform beyond the point C.

The angle between the platforms can vary from 0° to 107° during rising/lowering. This angle changes when the platform is raised/lowered due to the geometry of the guides and the specially organized kinematic scheme of the system.

To prevent icing of the guides 2, tubular (or other) seals can be installed along the edges of the longitudinal groove of the guide and cover it to prevent the ingress of snow and ice water into the guide 2. Busbars can also be used in waterproof design.

The platforms 31 may be equipped with a proximity control system with regard to the platform 31 positioned above or below the platform 31 when moving up or down. This system can operate in the following two modes:

- the first mode prevents double loading of the guides 2 by providing such a distance between the platforms 31 that would ensure the transfer of load to the guide 2 from only one platform 31,
- the second mode, if two platforms 31 can move along the same guides 2, ensures that the platforms 31 do not collide when moving up or down.

To ensure operation, the carriage proximity control system 33 includes sensors for measuring the load on the guides and for detecting the distance between the platforms. Each sensor, independently from the others, provides for the operation of the system in the two above modes. (The sensors are not shown in the figures.)

Realization of the invention.

The lifting and carrying system for maintaining building facades operates as follows. We consider the most comprehensive example of realization of the invention, keeping in mind that this example does not limit the application of the invention.

Figure 5:
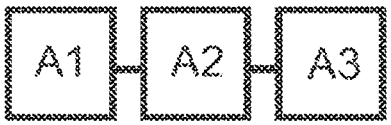

According to FIG. 5:

Step A1. To move the proposed system, guides 2 are required, which are secured to the building/structure using the brackets 22 and become a part of it. Therefore, these guides 2 are installed during construction of the building/structure or during its reconstruction.

Step A2. The assembly of the proposed system starts with installing the carriages 33 on the guides 2. Next, a platform 31 is installed, which in turn is assembled from the sections 311.

Step A3. The system is controlled from the control panel, which is a part of control means 5 and is carried by the maintenance personnel on the platform 31. The power supply of the lifting device drive motor 41 is performed via a busbar located inside the guide 2. (Not shown in the figures.)

In addition, the maintenance personnel as well as the personnel inside the building have radio communication in order to monitor operations and work performed by the maintenance personnel, as well as in the event of an emergency or emergency situation.

The sequence of steps is provided as an example, and allows you to rearrange, remove, add or perform certain operations simultaneously without losing the possibility of using it on the facades of buildings having a complex shape.

The principle of operation of the system allows the elements of the guide 2 to be installed in fragments, both as an assembly and a subassembly completed at the installation site, including using the platform 31 itself. For this purpose, the platform 31 is attached to the initial sections of the guide 2, and after inspection, it is moved upward until the upper carriage 33 reaches the limit point. Then the next section of the guide 2 is installed and secured on each side by installers from the platform 31 and the cycle is repeated.

INDUSTRIAL APPLICABILITY

The proposed lifting and carrying system for maintaining building facades can be practically implemented by a specialist, while realizing the claimed application, which enables drawing a conclusion about satisfying the "industrial applicability" criterion of the invention.

According to the proposed invention, calculations were made to determine the design parameters of the pilot version of the lifting and carrying system for maintaining building facades.

The calculations of the pilot version of the system showed that it provides the possibility to:

- adapt the shape of the platform itself to the shape of the curved facade,
- move the platform in a vertical direction while simultaneously changing its shape,
- connect several platforms into a single complex shape construction,
- have several platforms installed at different levels on the same guides, while excluding the possibility of increased load on the guides and eliminating the possibility of collision of different platforms moving along the same guides,
- stabilize the platform horizontally both in the longitudinal and transverse direction,
- quickly block the carriages from movement in case of emergency,
- control and limit the speed of the platform.

Thus, the invention achieves the stated objective, which consists in expanding the field of application of the system by allowing it to be used on facades of buildings having a complex shape.

An additional advantageous technical result of the proposed invention is that it allows to:

- clean the facades of buildings having a complex shape;
- perform glass replacement and repair facade structures of buildings having a complex shape;
- ensure the delivery of goods and personnel to the workplace.

What is claimed is:

1. A lifting and carrying system for maintaining building facades, comprising:

guides having a shape of a rail or mast located on the external wall of the building and provided with guide teeth, and a lifting device having a drive, wherein the drive includes a motor with a gearbox and a toothed wheel mounted on a drive shaft of the gearbox and capable of engaging with the guide teeth so that when the toothed wheel rotates, the lifting device moves along the guides; and control means capable of controlling the motor, wherein the guides have a shape that follows the shape of the building façade and are attached to the building by brackets passing through the façade of the building and secured to load-bearing structures of the building, wherein the lifting device includes a first platform and a second platform, wherein each of ends of each of the respective platforms is hinged to a respective frame, wherein each of the respective frames connects at least two respective carriages at the respective end of the respective platform, wherein each of the at least two respective carriages is hinged to the respective frame and forms a system of guiding thrust rollers, the thrust rollers resting on the guides, and wherein each of the first and second platforms is in the form of a telescopic sectional platform having a main support beam and comprising a plurality of telescopic sections each having a floor for maintenance personnel and a fence, wherein the telescopic sections including the floors and fences are telescopically engaged into each other and interlocked with the main support beam, wherein at least one the guides is at least one selected from the group consisting of inclined relative to the vertical or curved, and wherein an angle between the first and second platforms varies during rising or lowering of the platforms along the guides.

2. The lifting and carrying system according to claim 1, wherein the drive comprises a plurality of individual drives, wherein a respective one of the individual drives is attached to each carriage, wherein each individual drive moves the respective carriage along the guide by a gearwheel-toothed rack or by a sprocket-chain transmission.

3. The lifting and carrying system according to claim 1, wherein the control means include a speed limit control device to control the speed of the platform.

4. The lifting and carrying system according to claim 1, comprising another platform, wherein the control means includes a proximity control system of the platform with regard to the other platform located above or below when moving up or down, wherein the other platform is configured to operate in a first mode and in a second mode, wherein the first mode prevents double load on the guides and provides a distance between the platforms, ensuring transfer of load to the guide from only one of the platforms, and wherein the second mode ensures that the platforms do not collide when moving up or down, while the carriages include sensors for measuring guide load and distance between the platforms.

5. The lifting and carrying system according to claim 1, wherein the fence of each of the plurality of telescopic sections forms a spatial rod system.

* * * * *